US006721973B1

(12) United States Patent
Cristiano

(10) Patent No.: US 6,721,973 B1
(45) Date of Patent: Apr. 20, 2004

(54) BEACH BLANKET

(76) Inventor: Joseph F. Cristiano, 2132 85th St., Brooklyn, NY (US) 11214

( * ) Notice: Subject to any disclaimer, the term of this patent is extended or adjusted under 35 U.S.C. 154(b) by 0 days.

(21) Appl. No.: 09/965,729

(22) Filed: Sep. 27, 2001

(51) Int. Cl.[7] ..... A47G 9/06
(52) U.S. Cl. ..... 5/417; 5/485; 5/656; 383/4
(58) Field of Search ..... 5/417–420, 485, 5/656; 52/3; 383/4

(56) References Cited

U.S. PATENT DOCUMENTS

| | | | | |
|---|---|---|---|---|
| 3,226,737 A | | 1/1966 | Rote | 5/417 |
| D258,035 S | | 1/1981 | Fenwick | D6/603 |
| 4,654,906 A | | 4/1987 | Roberts | 5/417 |
| 5,018,229 A | | 5/1991 | Eberhart | 5/417 |
| 5,072,467 A | | 12/1991 | Hunt | 5/417 |
| 5,210,891 A | * | 5/1993 | Avital et al. | 5/419 |
| 5,443,880 A | | 8/1995 | Wike | 428/78 |
| 6,192,536 B1 | * | 2/2001 | Connors | 5/419 |

* cited by examiner

*Primary Examiner*—Thomas B. Will
*Assistant Examiner*—Tara L. Mayo

(57) ABSTRACT

A beach blanket includes a panel member that has an upper surface and lower surface. The lower surface is for resting on a beach. The upper surface is for supporting a user when the user lies on the upper surface such that the panel member is positioned between the user and the beach. The panel member has a plurality of anchor pockets. Each of the anchor pockets are positioned proximate a perimeter edge of the panel member. Each of the anchor pockets is for receiving some of the sand from the beach such that the anchor pockets anchor the panel member to the beach when the anchor pockets have some of the sand within the anchor pockets.

8 Claims, 2 Drawing Sheets

BEACH BLANKET

BACKGROUND OF THE INVENTION

1. Field of the Invention

The present invention relates to beach blankets and more particularly pertains to a new beach blanket for allowing a user to keep the present invention securely in place, so as not to be blown about easily by the wind.

2. Description of the Prior Art

The use of beach blankets is known in the prior art. More specifically, beach blankets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,226,737; 4,654,906; 5,018,229; 5,072.467; 5,443,880; and Des. 258,035.

While these devices fulfill their respective, particular objectives and requirements, the aforementioned patents do not disclose a new beach blanket. The inventive device includes a panel member that has an upper surface and lower surface. The lower surface is adapted for resting on a beach. The upper surface is adapted for supporting a user when the user lies on the upper surface such that the panel member is positioned between the user and the beach. The panel member has a plurality of anchor pockets. Each of the anchor pockets are positioned proximate a perimeter edge of the panel member. Each of the anchor pockets is adapted for receiving some of the sand from the beach such that the anchor pockets anchor the panel member to the beach when the anchor pockets have some of the sand within the anchor pockets.

In these respects, the beach blanket according to the present invention substantially departs from the conventional concepts and designs of the prior art, and in so doing provides an apparatus primarily developed for the purpose of allowing a user to keep the present invention securely in place, so as not to be blown about easily by the wind.

SUMMARY OF THE INVENTION

In view of the foregoing disadvantages inherent in the known types of beach blankets now present in the prior art, the present invention provides a new beach blanket construction wherein the same can be utilized for allowing a user to keep the present invention securely in place, so as not to be blown about easily by the wind.

The general purpose of the present invention, which will be described subsequently in greater detail, is to provide a new beach blanket apparatus and method which has many of the advantages of the beach blankets mentioned heretofore and many novel features that result in a new beach blanket which is not anticipated, rendered obvious, suggested, or even implied by any of the prior art beach blankets, either alone or in any combination thereof.

To attain this, the present invention generally comprises a panel member that has an upper surface and lower surface. The lower surface is adapted for resting on a beach. The upper surface is adapted for supporting a user when the user lies on the upper surface such that the panel member is positioned between the user and the beach. The panel member has a plurality of anchor pockets. Each of the anchor pockets are positioned proximate a perimeter edge of the panel member. Each of the anchor pockets is adapted for receiving some of the sand from the beach such that the anchor pockets anchor the panel member to the beach when the anchor pockets have some of the sand within the anchor pockets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beach blanket apparatus and method which has many of the advantages of the beach blankets mentioned heretofore and many novel features that result in a new beach blanket which is not anticipated, rendered obvious, suggested, or even implied by any of the prior art beach blankets, either alone or in any combination thereof.

It is another object of the present invention to provide a new beach blanket, which may be easily and efficiently manufactured and marketed.

It is a further object of the present invention to provide a new beach blanket, which is of a durable and reliable construction.

An even further object of the present invention is to provide a new beach blanket which is susceptible of a low cost of manufacture with regard to both materials and labor, and which accordingly is then susceptible of low prices of sale to the consuming public, thereby making such beach blanket economically available to the buying public.

Still yet another object of the present invention is to provide a new beach blanket, which provides in the apparatuses and methods of the prior art some of the advantages thereof, while simultaneously overcoming some of the disadvantages normally associated therewith.

Still another object of the present invention is to provide a new beach blanket for allowing a user to keep the present invention securely in place, so as not to be blown about easily by the wind.

Yet another object of the present invention is to provide a new beach blanket, which includes a panel member that has an upper surface and lower surface. The lower surface is adapted for resting on a beach. The upper surface is adapted for supporting a user when the user lies on the upper surface such that the panel member is positioned between the user and the beach. The panel member has a plurality of anchor pockets. Each of the anchor pockets are positioned proximate a perimeter edge of the panel member. Each of the anchor pockets is adapted for receiving some of the sand from the beach such that the anchor pockets anchor the panel member to the beach when the anchor pockets have some of the sand within the anchor pockets.

Still yet another object of the present invention is to provide a new beach blanket that allow the user more time to relax and not have to contend with the corners being turned over after being blown by the wind.

Even still another object of the present invention is to provide a new beach blanket that would incorporate pillows, which could be filled with sand to increase the user's comfort and enjoyment of the leisure time activity.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
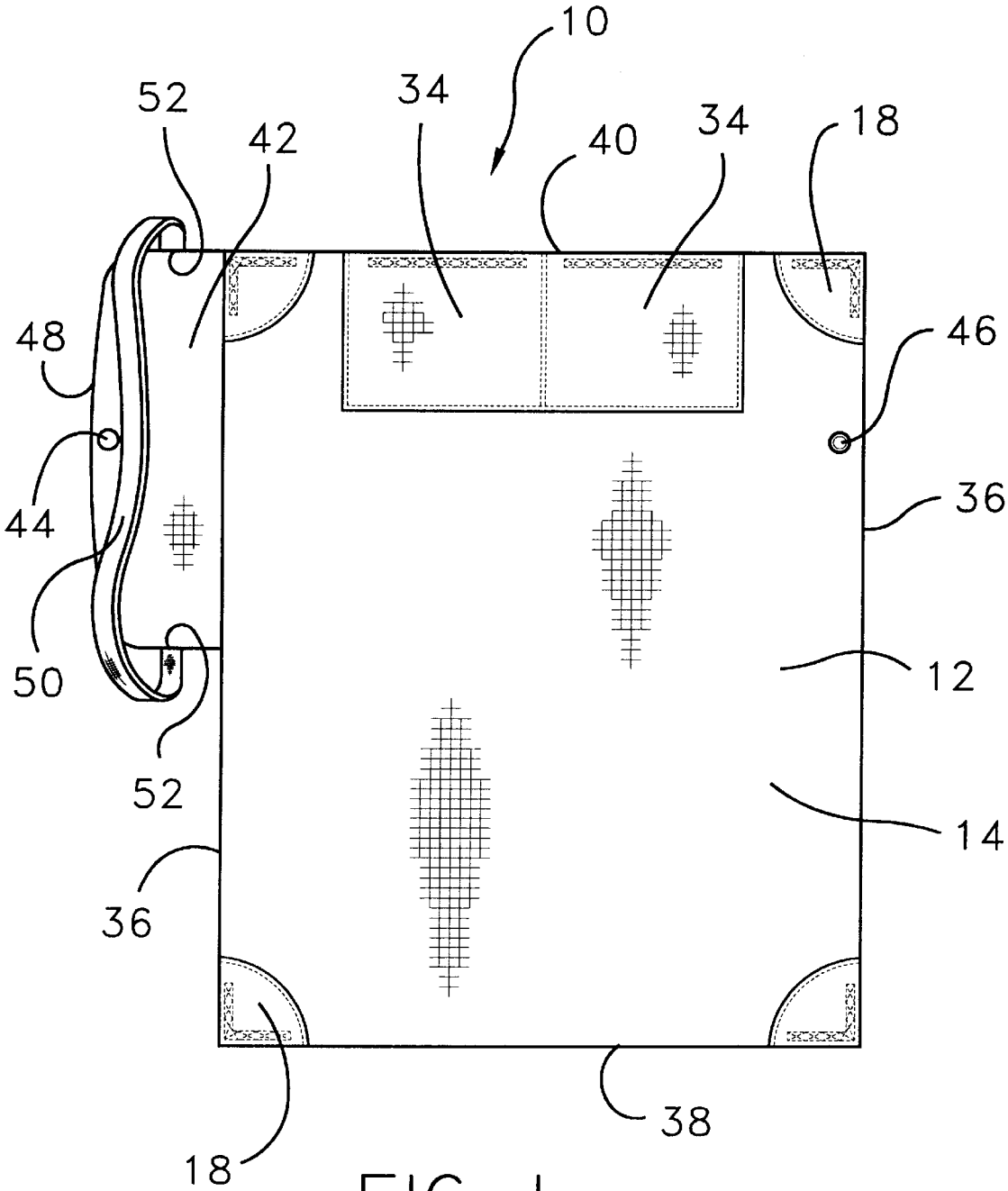
FIG. 1 is a top view of a new beach blanket according to the present invention.
Figure 2:
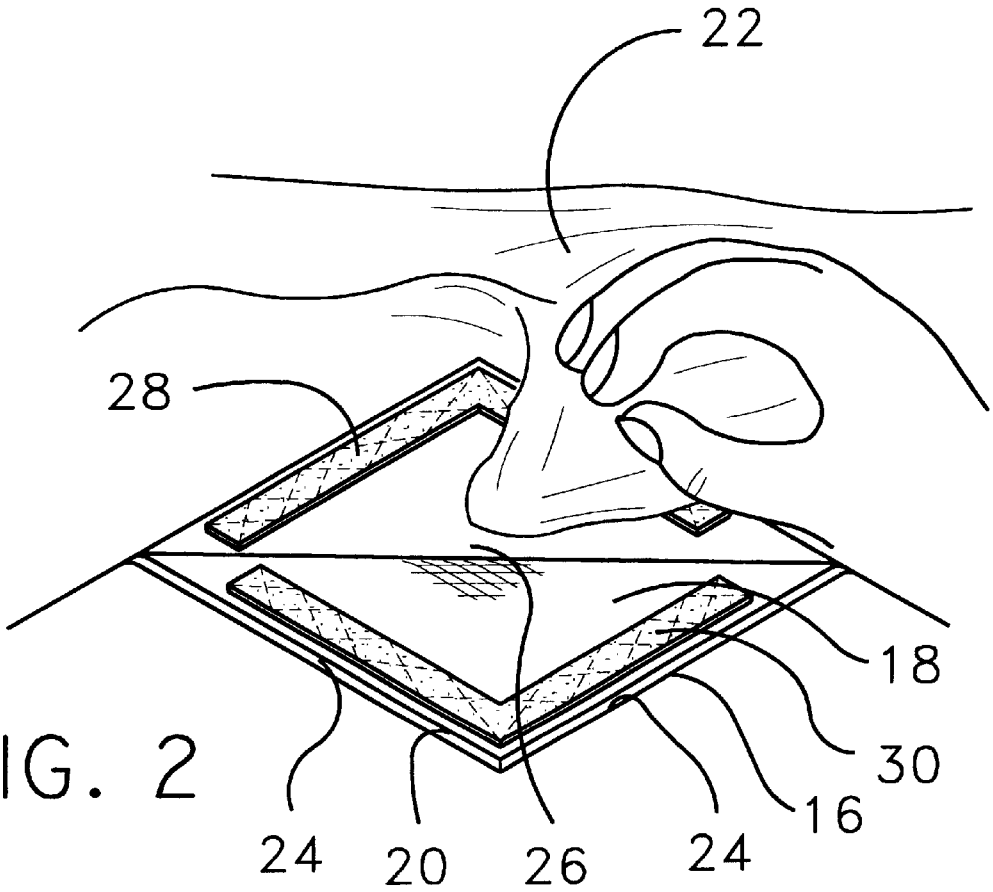
FIG. 2 is a perspective view of the present invention.
Figure 3:
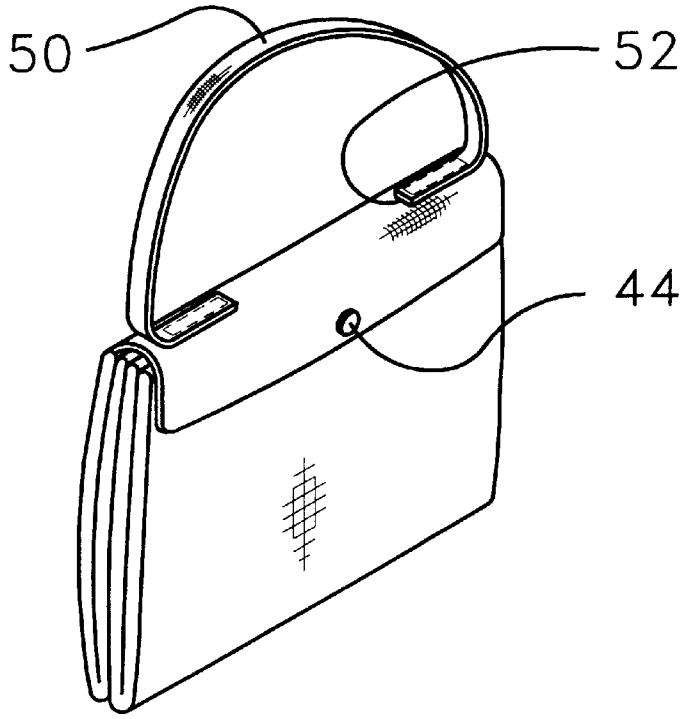
FIG. 3 is a perspective view of the present invention.

With reference now to the drawings, and in particular to FIGS. 1 through 3 thereof, a new beach blanket embodying the principles and concepts of the present invention and generally designated by the reference numeral 10 will be described.

As best illustrated in FIGS. 1 through 3, the beach blanket 10 generally includes a panel member 12 that has an upper surface 14 and lower, surface 16. The lower surface 16 is adapted for resting on a beach. The upper surface 14 is adapted for supporting a user when the user lies on the upper surface 14 such that the panel member 12 is positioned between the user and the beach. The panel member 12 has a plurality of anchor pockets 18. Each of the anchor pockets 18 are positioned proximate a perimeter edge 20 of the panel member 12. Each of the anchor pockets 18 is adapted for receiving some of the sand 22 from the beach such that the anchor pockets 18 anchor the panel member 12 to the beach when the anchor pockets 18 have some of the sand 22 within the anchor pockets 18.

Each of the anchor pockets 18 has a pair lead edges 24 and an anchoring edge 26. The lead edges 24 are positioned along the perimeter edge 20 of the panel member 12. The anchoring edge 26 is coupled to the panel member 12 such that an associated one of the anchor pockets 18 is separable along the lead edges 24 for permitting the sand 22 to be inserted into the associated one of the anchor pockets 18. Each of the anchor pockets 18 has a first portion of fastener member 28. The first portion of fastener member 28 is coupled proximate the lead edges 24 of the associated one of the anchor pockets 18. A second portion of fastener member 30 is coupled to the panel member 12 proximate each of the anchor pockets 18. The first portion of fastener member 28 is selectively couplable to the second portion of fastener member 30 such that each of the anchor pockets 18 is selectively closable when the first portion of fastener member 28 is coupled to the second portion of fastener member 30.

The anchoring edge 26 of each of the anchor pockets 18 is substantially arcuate. The anchoring edge 26 extends between the lead edges 24 of the associated one of the anchoring pockets 18 such that the anchoring edge 26 is adapted for facilitating removal of the sand 22 from the associated one of the anchor pockets 18.

A plurality of pillow pockets 34 is coupled to the panel member 12. Each of the pillow pockets 34 is adapted for receiving the sand 22. Each of the pillow pockets 34 is adapted for supporting a head of the user when the user is lying on the panel member 12 and the pillow pockets 34 are filled with sand 22.

The perimeter edge 20 of the panel member 12 has a pair of side edges 36. The panel member 12 is selectively foldable such that a bottom edge 38 of the perimeter edge 20 of the panel member 12 is positioned adjacent a top edge 40 of the perimeter edge 20 of the panel member 12. The panel member 12 is selectively foldable such that the side edges 36 of the perimeter edge 20 are positioned adjacent each other when the top edge 40 of the perimeter edge 20 is positioned adjacent the bottom edge 38 of the perimeter edge 20. A flap member 42 is coupled to one of the side edges 36 of the perimeter edge 20 of the panel member 12. The flap member 42 extends over the side edges 36 when the panel member 12 is in a folded position such that the flap member 42 is for retaining the panel member 12 in the folded position.

The flap member 42 has a first fastener portion 44. A second fastener portion 46 is coupled to the panel member 12. The second fastener portion 46 is positioned proximate one of the side edges 36 opposite the flap member 42. The first fastener portion 44 is selectively couplable to the second fastener portion 46 for securing a free end 48 of the flap member 42 to the panel member 12 such that the flap member 42 secures the panel member 12 in the folded position.

A strap 50 has a pair of ends 52. Each of the ends 52 of the strap 50 is coupled to the flap member 42 such that a distance between the ends across the flap member 42 is less than a length of the strap 50 when the ends 52 are coupled to the flap member 42. The strap 50 forms a loop adapted for receiving a portion of the body of the user for facilitating carrying of the panel member 12 when the is in the folded position.

In use, a user would spread the present invention out on the beach. The triangular pockets on each corner would be filled with a quantity of sand to securely hold the present invention in place. When not in use, the present invention would fold into a compact unit, which would be supported around a user's wais through an incorporated belt.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beach blanket comprising:

a panel member having an upper surface and lower surface, said lower surface being adapted for resting on a beach, said upper surface being adapted for supporting a user when the user lies on said upper surface such that said panel member is positioned between the user and the beach;

said panel member having a plurality of anchor pockets, each of said anchor pockets being positioned proximate a perimeter edge of said panel member, each of said anchor pockets being adapted for receiving some of the sand from the beach such that said anchor pockets anchor said panel member to the beach when said anchor pockets have some of the sand within said anchor pockets; and said perimeter edge of said panel member having a pair of side edges, said panel member being selectively foldable such that a bottom edge of said perimeter edge of said panel member is positioned adjacent a top edge of said perimeter edge of said panel member, said panel member being selectively foldable such that said side edges of said perimeter edge are positioned adjacent each other when said top edge of said perimeter edge is positioned adjacent said bottom edge of said perimeter edge, a flap member being coupled to one of said side edges of said perimeter edge of said panel member, said flap member extending over said side edges when said panel member is in a folded position such that said flap member is for retaining said panel member in said folded position.

2. The beach blanket as set forth in claim 1, further comprising:

each of said anchor pockets having a pair lead edges and an anchoring edge, said lead edges being positioned along said perimeter edge of said panel member, said anchoring edge being coupled to said panel member such that an associated one of said anchor pockets is separable along said lead edges for permitting the sand to be inserted into the associated one of said anchor pockets.

3. The beach blanket as set forth in claim 2, further comprising:

each of said anchor pockets having a first portion of fastener member, said first portion of fastener member being coupled proximate said lead edges of the associated one of said anchor pockets, a second portion of fastener member being coupled to said panel member proximate each of said anchor pockets, said first portion of fastener member being selectively couplable to said second portion of fastener member such that each of said anchor pockets are selectively closable when said first portion of fastener member is coupled to said second portion of fastener member.

4. The beach blanket as set forth in claim 2, further comprising:

said anchoring edge of each of said anchor pockets being substantially arcuate, said anchoring edge extending between said lead edges of the associated one of said anchor pockets such that said anchoring edge is adapted for facilitating removal of the sand from the associated one of said anchor pockets.

5. The beach blanket as set forth in claim 1, further comprising:

a plurality of pillow pockets being coupled to said panel member, each of said pillow pockets being adapted for receiving the sand, each of said pillow pockets being adapted for supporting a head of the user when the user is lying on said panel member and said pillow pockets are filled with sand.

6. The beach blanket as set forth in claim 1, further comprising:

said flap member having a first fastener portion, a second fastener portion being coupled to said panel member, said second fastener portion being positioned proximate one of said side edges opposite said flap member, said first fastener portion being selectively couplable to said second fastener portion for securing a free end of said flap member to said panel member such that said flap member secures said panel member in said folded position.

7. The beach blanket as set forth in claim 1, further comprising:

a strap having a pair of ends, each of said ends of said strap being coupled to said flap member such that a distance between said ends across said flap member is less than a length of said strap when said ends are coupled to said flap member, said strap forming a loop adapted for receiving a portion of the body of the user for facilitating carrying of said panel member when said panel member is in said folded position.

8. A beach blanket comprising:

a panel member having an upper surface and lower surface, said lower surface being adapted for resting on a beach, said upper surface being adapted for supporting a user when the user lies on said upper surface such that said panel member is positioned between the user and the beach;

said panel member having a plurality of anchor pockets, each of said anchor pockets being positioned proximate a perimeter edge of said panel member, each of said anchor pockets being adapted for receiving some of the sand from the beach such that said anchor pockets anchor said panel member to the beach when said anchor pockets have some of the sand within said anchor pockets;

wherein each of said anchor pockets having a pair lead edges and an anchoring edge, said lead edges being positioned along said perimeter edge of said panel member, said anchoring edge being coupled to said panel member such that an associated one of said anchor pockets is separable along said lead edges for permitting the sand to be inserted into the associated one of said anchor pockets;

wherein each of said anchor pockets having a first portion of fastener member, said first portion of fastener member being coupled proximate said lead edges of the associated one of said anchor pockets, a second portion of fastener member being coupled to said panel member proximate each of said anchor pockets, said first portion of fastener member being selectively couplable to said second portion of fastener member such that each of said anchor pockets are selectively closable when said first portion of fastener member is coupled to said second portion of fastener member;

wherein said anchoring edge of each of said anchor pockets being substantially arcuate, said anchoring edge extending between said lead edges of the associated one of said anchor pockets such that said anchoring edge is adapted for facilitating removal of the sand from the associated one of said anchor pockets;

wherein a plurality of pillow pockets being coupled to said panel member, each of said pillow pockets being adapted for receiving the sand each of said pillow pockets being adapted for supporting a head of the user when the user is lying on said panel member and said pillow pockets are filled with sand;

wherein said perimeter edge of said panel member having a pair of side edges, said panel member being selectively foldable such that a bottom edge of said perimeter edge of said panel member is positioned adjacent a top edge of said perimeter edge of said panel member, said panel member being selectively foldable such that said side edges of said perimeter edge are positioned adjacent each other when said top edge of said perimeter edge is positioned adjacent said bottom edge of said perimeter edge, a flap member being coupled to one of said side edges of said perimeter edge of said panel member, said flap member extending over said side edges when said panel member is in a folded position such that said flap member is for retaining said panel member in said folded position;

wherein said flap member having a first fastener portion, a second fastener portion being coupled to said panel member, said second fastener portion being positioned proximate one of said side edges opposite said flap member, said first fastener portion being selectively couplable to said second fastener portion for securing a free end of said flap member to said panel member such that said flap member secures said panel member in said folded position;

wherein a strap having a pair of ends, each of said ends of said strap being coupled to said flap member such that a distance between said ends across said flap member is less than a length of said strap when said ends are coupled to said flap member, said strap forming a loop adapted for receiving a portion of the body of the user for facilitating carrying of said panel member when said panel member is in said folded position.

* * * * *

UNITED STATES PATENT AND TRADEMARK OFFICE
Certificate

Patent No. 6,721,973 B1 Patented: April 20, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Joseph F. Cristiano, Howell, NJ; and John Matone, Jr., Brooklyn, NY.

Signed and Sealed this Fifteenth Day of November 2005.

THOMAS B. WILL
*Supervisory Patent Examiner*
Art Unit 3671